US006851236B1

(12) United States Patent
Harvey

(10) Patent No.: US 6,851,236 B1
(45) Date of Patent: Feb. 8, 2005

(54) RAISED TERRACE FLOOR USING SMALL PAVING BLOCKS

(75) Inventor: Jeffrey T. Harvey, Baldwinsville, NY (US)

(73) Assignee: Syrstone, Inc., North Syracuse, NY (US)

( * ) Notice: Subject to any disclaimer, the term of this patent is extended or adjusted under 35 U.S.C. 154(b) by 0 days.

(21) Appl. No.: 09/768,996

(22) Filed: Jan. 24, 2001

(51) Int. Cl.[7] ..... E04F 15/22

(52) U.S. Cl. ..... 52/403.1; 52/263; 52/262; 52/385; 52/342; 404/18; 404/31; 404/34

(58) Field of Search ..... 52/180, 478, 236.5, 52/650.1, 177, 169.9, 662, 676, 220.3, 220.4, 263, 762, 480, 403.1, 220, 260, 220.5, 220.6, 220.1, 385, 342; 404/29, 17, 18, 28, 31, 34, 35, 43

(56) References Cited

U.S. PATENT DOCUMENTS

| | | | | | |
|---|---|---|---|---|---|
| 442,784 | A | * | 12/1890 | Schmidt | 404/43 |
| 638,870 | A | * | 12/1899 | Jackson | 52/418 |
| 719,790 | A | * | 2/1903 | Gregory | 404/42 |
| 776,419 | A | * | 11/1904 | Platt | 404/43 |
| RE20,872 | E | * | 10/1938 | Focht | 52/263 |
| 3,065,506 | A | * | 11/1962 | Tremer | 52/126.6 |
| 3,085,482 | A | * | 4/1963 | Yakubik | 404/31 |
| 3,877,189 | A | * | 4/1975 | Mauell | 52/475.1 |
| 4,706,424 | A | * | 11/1987 | Garapick et al. | 52/181 |
| 4,852,315 | A | * | 8/1989 | Fukayama | 52/220.3 |
| 4,883,503 | A | * | 11/1989 | Fish | 52/220 |
| 5,238,721 | A | * | 8/1993 | Nakazawa | 428/44 |
| 5,323,575 | A | * | 6/1994 | Yeh | 52/177 |
| 5,363,614 | A | * | 11/1994 | Faulkner | 52/263 |
| 5,364,204 | A | * | 11/1994 | MacLeod | 404/35 |
| 5,666,772 | A | * | 9/1997 | Betty | 52/177 |
| 5,761,867 | A | * | 6/1998 | Carling | 52/386 |
| 5,904,015 | A | * | 5/1999 | Chen | 52/220.2 |
| 5,906,084 | A | * | 5/1999 | Millington et al. | 52/650.3 |
| 5,924,905 | A | * | 7/1999 | Cyrus et al. | 446/118 |
| 5,993,283 | A | * | 11/1999 | Cyrus et al. | 446/124 |
| 6,171,015 | B1 | * | 1/2001 | Barth et al. | 404/34 |
| 6,202,374 | B1 | * | 3/2001 | Cooper et al. | 52/220.3 |
| 6,344,254 | B1 | * | 2/2002 | Smith et al. | 428/95 |
| 2002/0092249 | A1 | * | 7/2002 | Yin | 52/263 |

FOREIGN PATENT DOCUMENTS

| | | | | |
|---|---|---|---|---|
| DE | 2314463 | * | 2/1975 | 52/263 |
| DE | 3415581 | * | 11/1985 | 52/263 |
| FR | 16001001 | * | 8/1970 | 52/263 |
| FR | 1601001 | * | 9/1970 | 52/263 |
| FR | 2041599 | * | 1/1971 | 52/263 |
| GB | 876117 | * | 8/1961 | 52/263 |
| GB | 1425977 | * | 2/1976 | 52/264 |
| GB | 2097836 | * | 11/1982 | 52/263 |

* cited by examiner

*Primary Examiner*—Lanna Mai
*Assistant Examiner*—Phi Dieu Tran A
(74) *Attorney, Agent, or Firm*—Wall Marjama & Bilinski LLP

(57) ABSTRACT

A horizontally level raised terrace floor system for mounting over a non-level or irregular substructure that includes a plurality of spaced apart support pedestals that are fabricated of a heat shearable foam material. Each pedestal is mounted upon the non-horizontally level substructure and the pedestals are heat sheared so that the top surface of each pedestal lies in a common horizontal plane above the substructure. A plurality of flat grates are placed directly upon the pedestals in an edge to edge relationship. A plurality of interlocking paving blocks are laid down over the grates to provide a tight deck over the grates.

8 Claims, 5 Drawing Sheets

RAISED TERRACE FLOOR USING SMALL PAVING BLOCKS

FIELD OF THE INVENTION

This invention relates generally to an improved terrace floor system, and specifically to a raised terrace floor system for supporting small interlocking paving blocks upon a sloping or irregular substructure such as a non-horizontally level roof top surface.

BACKGROUND OF THE INVENTION

In U.S. Pat. No. 5,363,614 to Faulkner, there is described a raised terrace floor system that can be quickly and economically laid down upon a sloping or irregular subsurface to provide a level deck. The system involves the use of foam pedestals that are mounted upon the non-level substructure. The pedestals are then sheared using a hot wire cutter so that the top surfaces of the pedestals are all horizontally level. The pedestals are laid down in rows and columns so that relatively large paving blocks can be set upon the top of the pedestals in corresponding rows and columns thus establishing the deck. Joint dividers are placed upon the top of the pedestals when the corners of the blocks come together thus insuring that the blocks are uniformly spaced and aligned over the deck surface.

The above described Faulkner system, because it can be quickly and accurately installed, has found wide acceptance, particularly in buildings such as high rise structures having one or more set back locations. The rooftop area at the set backs are typically sloped in one or more directions to provide drainage of rain water or melting snow and thus avoid the problems associated with standing water. When installed on a rooftop or the like, the Faulkner system provides a highly usable terrace that can be put to any number of practical uses, thus utilizing what has heretofore been wasted space.

The Faulkner system, as described in the above noted '614 patent, typically employs 8 inch square pedestals that are spaced apart on 2 foot centers. Smaller interlocking pavers which are about equal in size of a standard brick cannot be facilitated by the system because of the wide spacing between pedestals.

SUMMARY OF THE INVENTION

It is therefore an object of the present invention to improve raised terrace systems for installation on sloping or irregular substructures.

A further object of the present invention is to provide a horizontally level raised pedestal terrace system that can accommodate small interlocking paving blocks.

A still further object of the present invention is to provide a horizontally level raised pedestal terrace system utilizing small interlocking paving blocks that can be simply and quickly installed to provide a secure floor surface.

These and other objects of the present invention are attained by means of a horizontally level raised floor system that can be rapidly and securely placed over an existing, irregular, or sloped substructure. Spaced apart pedestals fabricated of a heat shearable foam material are mounted upon the non-horizontal substructure and the pedestals are sheared to produce upper surfaces that are horizontally level. A plurality of flat grate panels having small openings are laid directly upon the pedestals and small interlocking paving blocks are laid over the grate panels to provide a tight, relatively high strength deck that is highly decorative and relatively impervious to the elements and wear.

BRIEF DESCRIPTION OF THE DRAWING

For a further understanding of these and objects of the invention, reference will be made to the following detailed description of the invention which is to be read in connection with the accompanying drawing, wherein.

DETAILED DESCRIPTION OF THE INVENTION

Figure 1:
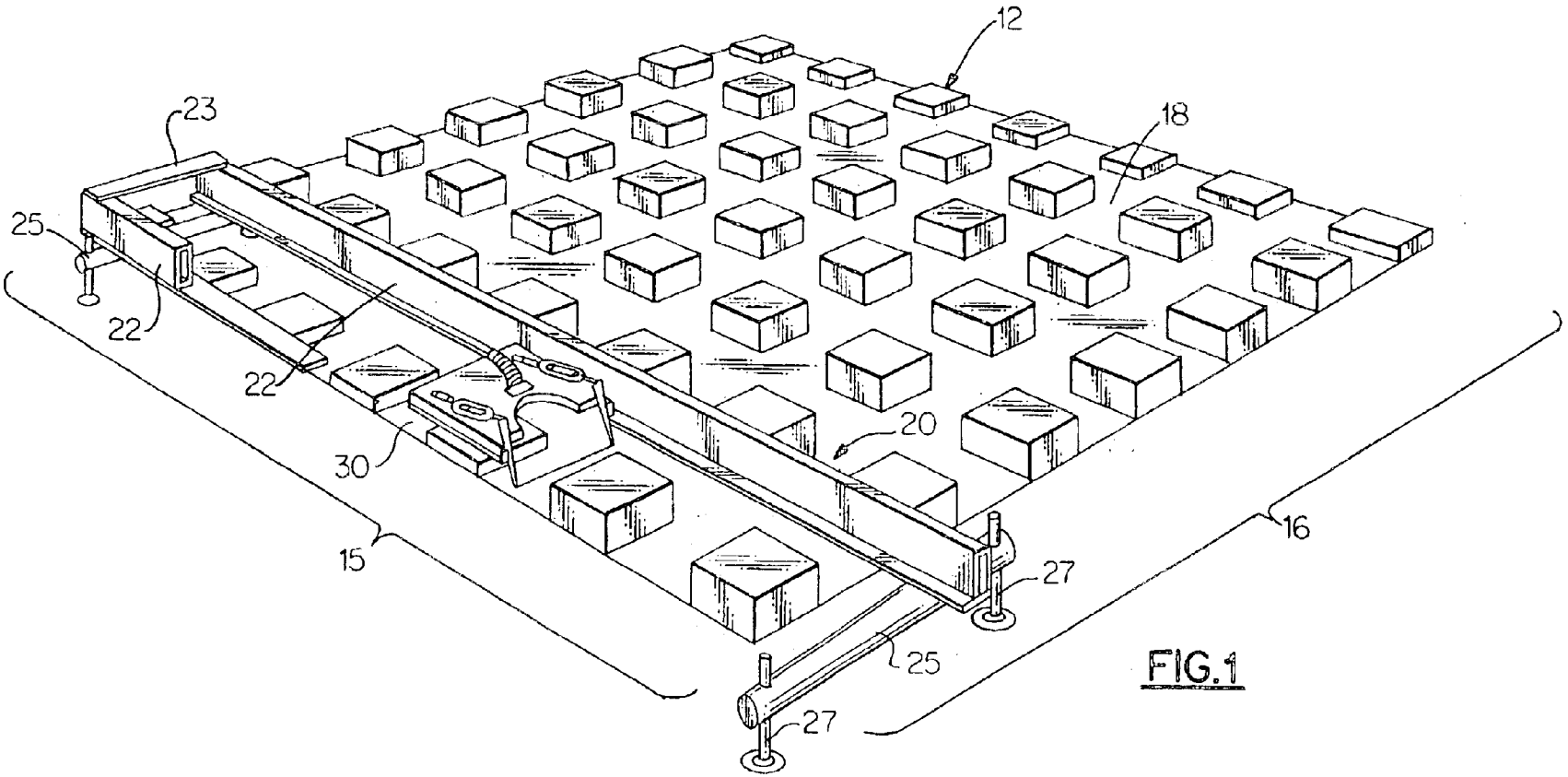
FIG. 1 is a perspective view illustrating the horizontal leveling of a single row of heat shearable pedestals utilized in the practice of the present invention.
Figure 2:
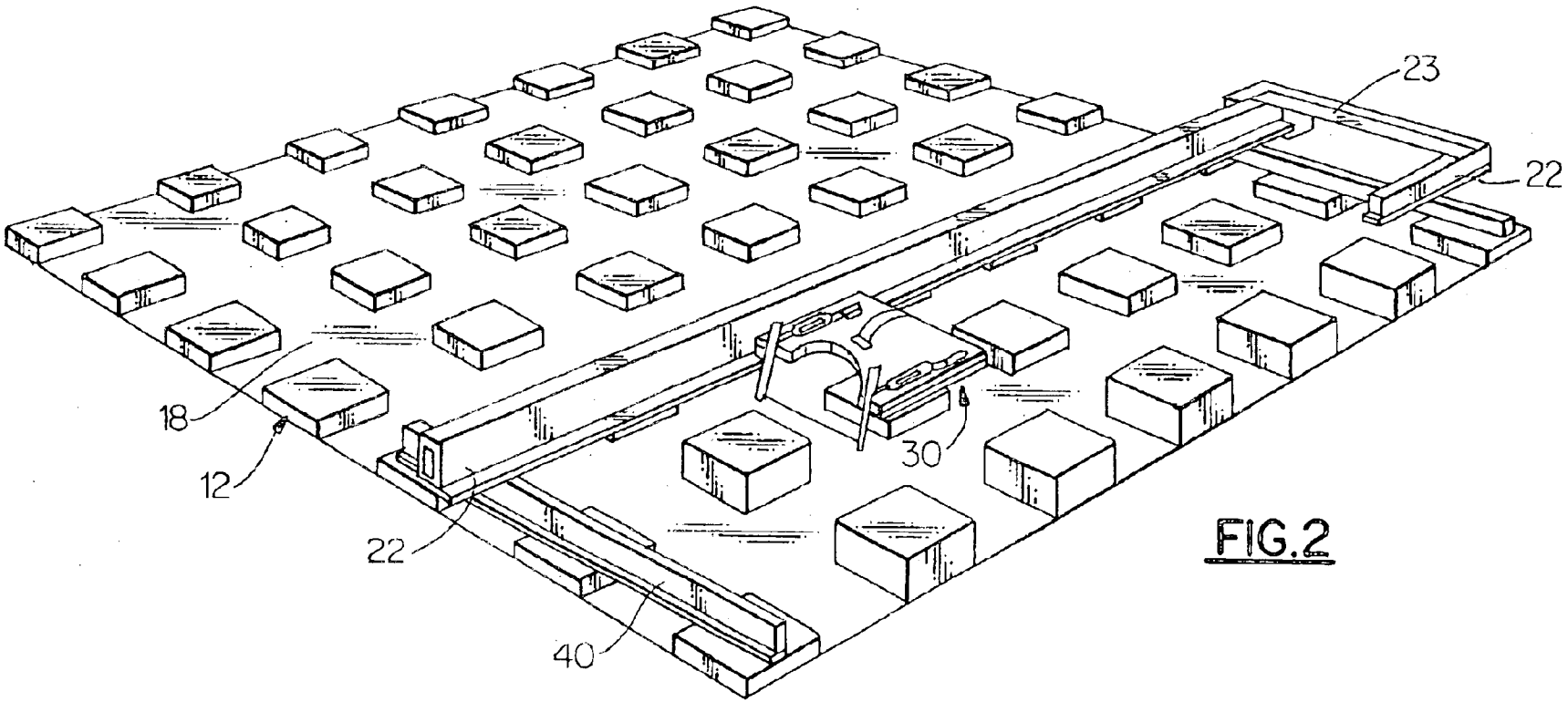
FIG. 2 is a perspective view illustrating the horizontal leveling of a single column of pedestals based upon the elevation of a previously level row.
Figure 3:
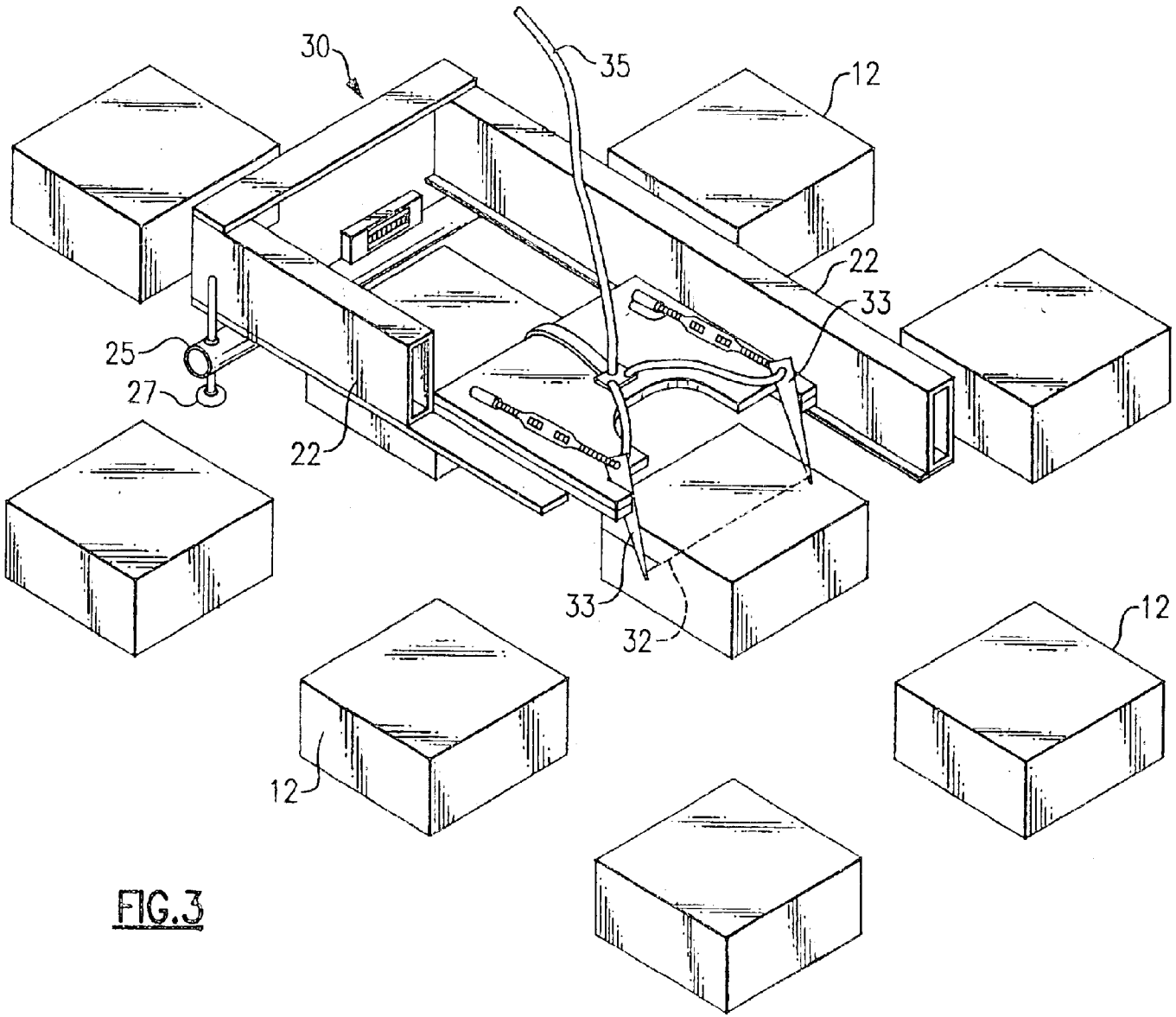
FIG. 3 is a perspective view of the leveling carriage used in the practice of the present invention with portions broken away for the purpose of clarity.

Referring now to FIGS. 1–3, there is illustrated a number of heat shearable pedestals 12 that are mounted on an existing floor in vertical columns, such as column 15, and horizontal rows such as row 16. The existing floor, herein referred to as a substructure 18, is irregular and slopes in one or more directions towards drains for carrying away rain water or the like. This causes special problems when attempting to lay a level deck over the substructure. As illustrated in FIG. 1, a specially constructed leveling apparatus, generally referenced 20 is employed to rapidly and efficiently shear the upper part of each pedestal so that the top surfaces of the pedestals all lie in a common horizontally level plane.

As described in the previous referenced 5,363,614 patent, the disclosure of which is herein incorporated by reference, the pedestals are formed of a high density foam, such as polystyrene, and are secured to the substructure using an appropriate polystyrene compatible adhesive. The height of the pedestals are such that each extends upward to a height greater than the desired elevation of the deck. Initially, the first column in the pattern is leveled or aligned within the desired horizontal plane. This is achieved by placing a pair of spaced apart tracks 22—22 on either side of the pedestals in this first column. A connector plate 23 ties at least one end of the two rails together as shown in FIG. 1 and the two ends of the rails are supported on cross members 25. Each cross member, in turn, is supported upon adjustable leveling legs 27—27. Using the adjustable leveling legs and a laser gun, the rails can be brought to a desired horizontally level position on either side of the column.

A cutting carriage 30, as shown in FIG. 3, is mounted between the tracks so that it can move freely over the pedestals in the column. The carriage contains a heatable cutting wire 32 which is horizontally disposed beneath the carriage between two support arms 33—33. The wire is stretched tightly in a straight horizontal line between the arms and is connected to a suitable source of electrical power (not shown) by electrical lead 35 for heating the wire to a temperature suitable for shearing the tops of the pedestals. In practice, a direct current of between 2 and 50 amps is used to heat a 0.02" to 0.05" stainless steel wire to about 1200° F., which is the preferred shearing temperature for polystyrene.

Once the wire is heated to the desired shearing temperature, the carriage is moved manually along the tracks so that each pedestal in the column is cut to the same horizontally aligned elevation.

After a first column of pedestals has been sheared, a second column of pedestals spaced some distance from the first is then sheared and grade supports 40—40 are seated upon pedestals in the two sheared columns, as shown in FIG. 2. The tracks are now turned 90° and seated upon the grade supports on either side of a column that contains unsheared pedestals and the carriage is moved over the column to shear all the pedestals in the column to the desired level. The tracks are similarly repositioned with regard to the other unsheared rows until all the pedestals are cut level within a common horizontal plane.

Figure 4:
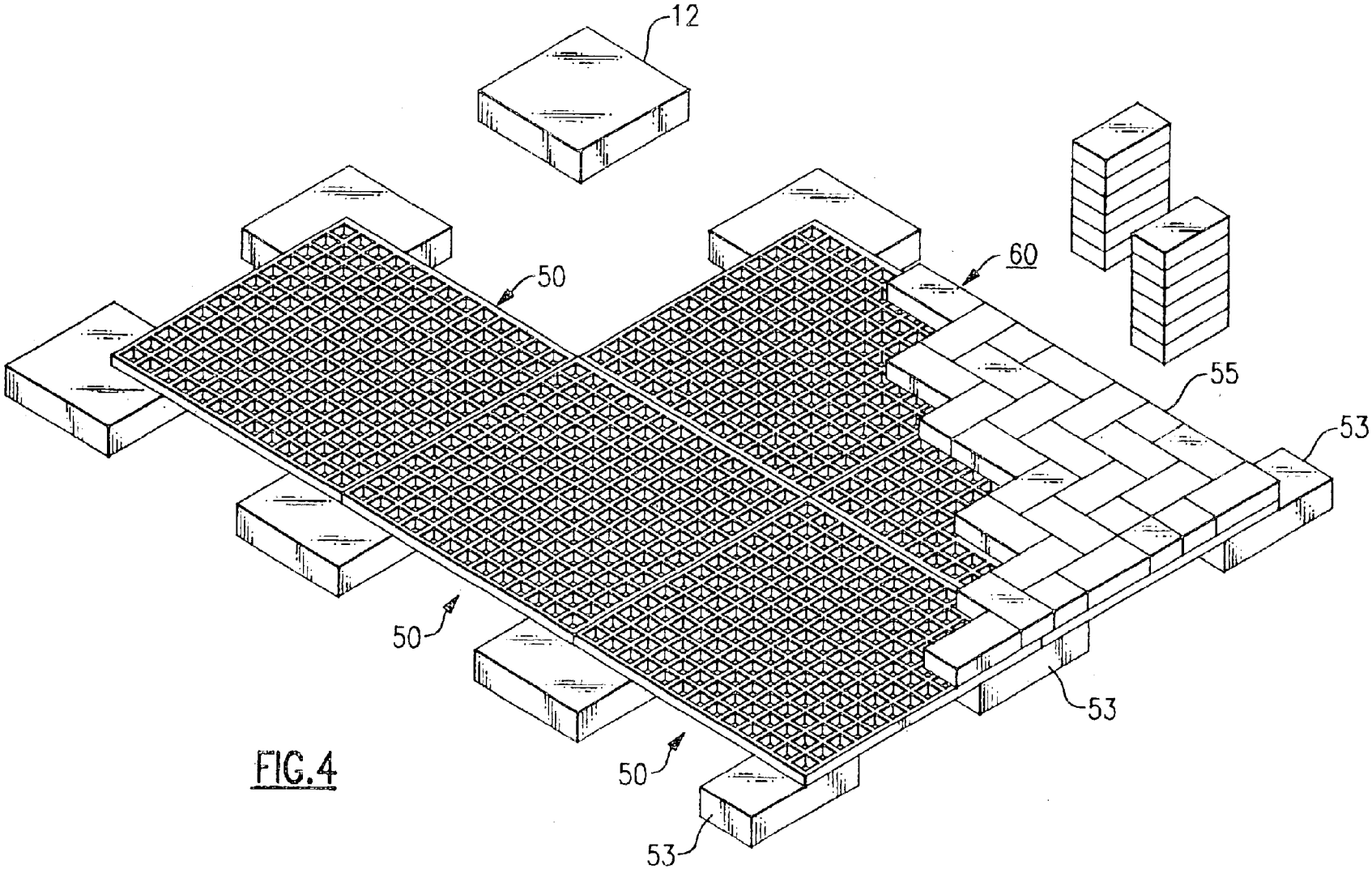
FIG. 4 is a perspective view illustrating a raised horizontally level pedestal terrace system embodying the teachings of the present invention.
Figure 5:
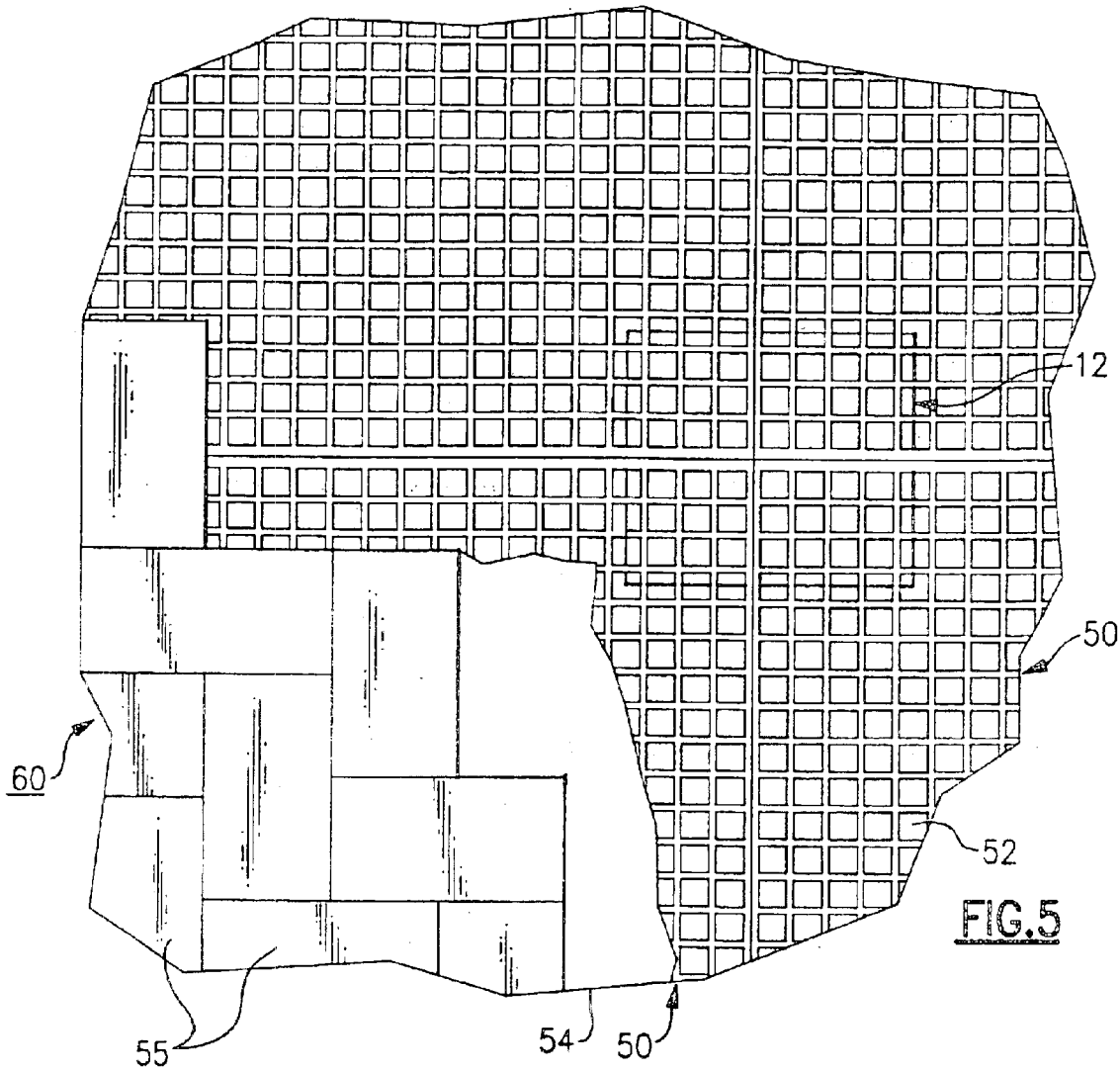
FIG. 5 is a partial top plan view of the present terrace system.
Figure 6:
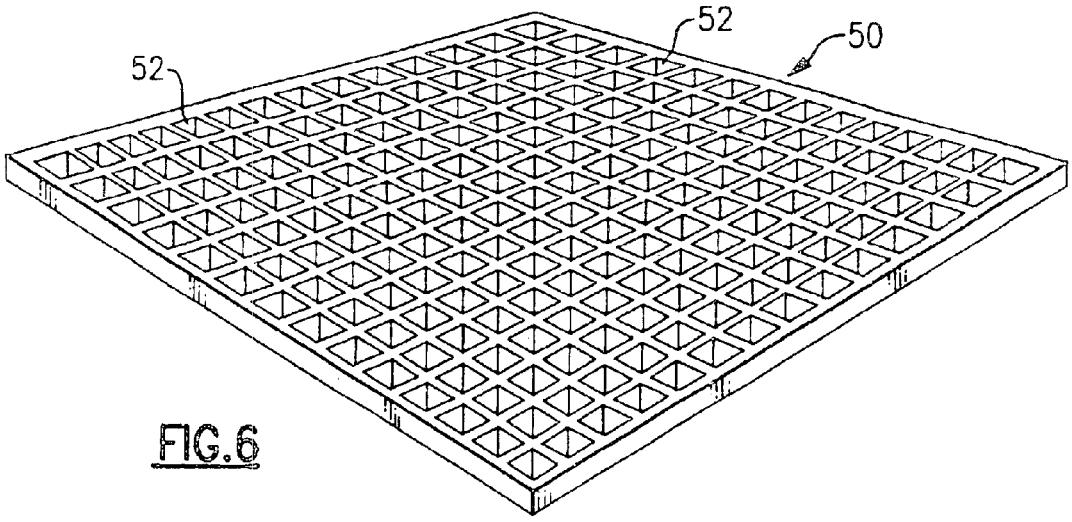
FIG. 6 is a perspective view showing one of the grate panels used in the practice of the present invention.

Turning now to FIGS. 4–6, a series of rectangular grate panels 50 are mounted so that the four corners of each panel rests upon the top surface of four pedestals that reside in adjacent rows and columns. The pedestals are spaced apart in the rows and columns on equal centers so that the corners of the panels come together at the center of the pedestals to establish a subfloor. The pedestals in the outermost rows and columns may be cut along the center axis of the row or column so that the edges of the edge pedestals 53 (FIG. 4) are parallely aligned with the outer edges of the overlying panels. In this way, the panels can be brought in close alignment with the sidewalls of a terrace or balcony that form the perimeter of the substructure. Preferably, the panels are placed in edge to edge contact upon the pedestals or alternatively, a cruciform joint divider can be used to help space and align the grate panels in assembly. The grate panels can be made of any suitable material such as steel, aluminum, plastic or fiberglass, depending upon the specific deck application and its intended load carrying capability. Each grate panel contains a series of perforations 52—52 that pass downwardly through the top and bottom surfaces of the panels which reduce the weight of the panels without substantially reducing the load carrying capacity of the system. Although the perforations are shown as being square shaped and parallely aligned, the perforations can be almost any shape and can be placed in any suitable pattern which will not adversely effect the panel's load carrying capacity.

A series of small interlocking paving blocks 55—55 are laid down upon the top surfaces of the panel in an interlocking pattern to complete the deck upper floor 60. As noted above, the interlocking block are about the same size as a standard brick and can be laid down in an interlocking pattern as shown in FIGS. 4 and 5 to provide a very tight, but decorative deck that is relatively impervious to weather and capable of handling a good deal of traffic without showing appreciable wear. The term interlocking, as herein used, refers to a block pattern wherein the joints between the blocks do not coact to create long seam lines. The seam lines of the interlocking blocks are relatively short and dead end at a side wall of another adjacent block as shown in FIGS. 4 and 5. Once in place, the interlocked blocks form a tight pattern that resists lateral movement in all directions. A sheet 57 of geotextile material may be laid on top of the panel network to protect the panel from the paving block, particularly in areas where the deck loading will be relatively high. The sheets of geotextile material will also serve to deaden unwanted noise that might be created by the pavers rubbing against the grates. Lastly, the perforations formed in the grates are relatively small in comparison to the surface area of the pavers so that the pavers can be well seated upon the top of the panels with little or no relative movement therebetween.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. A raised load bearing exterior floor system for mounting upon a non-level terrace, said system including:

a plurality of spaced apart support pedestals mounted upon the terrace, said pedestals having coplanar horizontally disposed top surfaces;

a plurality of high strength load bearing grate panels, each of said grate panels containing a continuous series of perforations formed over the entirety of each said prate panel, said grate panels being mounted upon the coplanar top surfaces of said pedestals, so that each grate panel is supported at each of its corners upon one of said pedestals and each of said grate panels being in abutting relation to establish a continuous raised load bearing subfloor over said terrace, said subfloor being defined by a continuous series of perforations over the entirety thereof; and a plurality of paving bricks disposed onto a top surface of said perforated grate panels, said paving bricks being arranged in an interlocking locking relationship with each other, the bottom surface of each said paving brick being set upon the top surface of said grate panels to establish an upper floor, the area between said pedestals being substantially greater than the surface area of each of said paving bricks wherein each said paving brick of said upper floor is evenly supported by a plurality of said continuous series of perforations of at least one grate panel of said subfloor, said paving bricks being fabricated of a weather impervious material and in which the plurality of paving bricks can selectively assume a plurality of interlocking configurations on top) of said grate panels in establishing said upper floor based on the relative positioning of said paving bricks with one another, the positioning of said paving bricks in an interlocking configuration forming a plurality of discontinuous seam lines, wherein at least some of said seam lines terminate at a side wall of an interlocking paving brick.

2. The exterior floor system of claim 1 wherein said grate panels are rectangularly shaped.

3. The exterior floor system of claim 1 wherein said pedestals are fabricated of a high density foam.

4. The exterior floor system of claim 1 wherein said pedestals are fabricated of polystyrene.

5. The exterior floor system of claim 1 that further includes a geotextile material located between the plurality of paving bricks and the grate panels.

6. The exterior floor system of claim 1, wherein each of said pedestals are fabricated of a heat shearable material, said pedestals being directly affixed in spaced apart relationship onto a non-horizontally level terrace substructure, said pedestals being of non-uniform heights such that all of the top surfaces of said pedestals are horizontally level with one another to form said coplanar top surfaces and said top surfaces are non-parallel with respect to corresponding pedestal lower surfaces.

7. The exterior floor system of claim 6, wherein said pedestals are affixed to said substructure by means of a polystyrene adhesive.

8. A method of creating an exterior raised load bearing floor system for mounting upon a non level terrace, said method including the steps of:

affixing a plurality of spaced apart support pedestals upon the terrace, said pedestals having coplanar horizontally disposed top surfaces;

mounting a plurality of high strength load bearing grate panels upon the coplanar top surfaces of said pedestals, each of said grate panels having a continuous series of small perforations, said grate panels when mounted being supported at each of its corners upon one of said pedestals and each of said grate panels being in abutting relation to establish a continuous raised load bearing subfloor over said terrace, said subfloor being defined by a top surface having said continuous series of small perforations, and selectively disposing a plurality of paving blocks onto said top surface of said subfloor, said paving blocks being selectively arrangeable in one of a plurality of interlocking relationships upon said grate panels to establish an upper floor, the area between said pedestals being substantially greater than the surface area of each of said paving blocks wherein each paving brick is evenly supported by a plurality of said perforations of at least one grate panel, said paving blocks being fabricated of a weather impervious material.

* * * * *

UNITED STATES PATENT AND TRADEMARK OFFICE

CERTIFICATE OF CORRECTION

PATENT NO. : 6,851,236 B1
DATED : February 8, 2005
INVENTOR(S) : Harvey

It is certified that error appears in the above-identified patent and that said Letters Patent is hereby corrected as shown below:

Column 4,
Line 20, “prate” should be -- grate --.

Signed and Sealed this

Seventeenth Day of May, 2005

JON W. DUDAS
*Director of the United States Patent and Trademark Office*